United States Patent [19]

Perlstein et al.

[11] 4,429,030

[45] Jan. 31, 1984

[54] PHOTOCONDUCTIVE COMPOSITIONS

[75] Inventors: Jerome H. Perlstein; George A. Reynolds; James A. VanAllan; Suzanne P. Clark, all of Rochester, N.Y.

[73] Assignee: Eastman Kodak Company, Rochester, N.Y.

[21] Appl. No.: 435,524

[22] Filed: Oct. 20, 1982

Related U.S. Application Data

[63] Continuation-in-part of Ser. No. 874,971, Feb. 3, 1978, abandoned, which is a continuation-in-part of Ser. No. 855,141, Nov. 28, 1977, abandoned.

[51] Int. Cl.[3] ..... G03G 5/06; G03G 5/14

[52] U.S. Cl. ..... 430/75; 430/58; 430/83

[58] Field of Search ..... 430/78, 83, 96, 58, 430/75

[56] References Cited

U.S. PATENT DOCUMENTS 3,615,414 10/1971 Light .
3,873,311 3/1975 Contois et al. .
3,938,994 2/1976 Reynolds et al. .

*Primary Examiner*—John E. Kittle

*Assistant Examiner*—John L. Goodrow

*Attorney, Agent, or Firm*—John R. Everett

[57] ABSTRACT

Photoconductive compositions having both high-speed and high-resolution are disclosed. The composition comprises a film forming electrically insulating polymer and a dye in the form of a dye-dye complex, having a structure according to the formula wherein X⊖ represents an anion; the dye has an absorption spectrum which changes when a binderless coating of the dye is treated with solvent vapors, and the composition containing the dye-dye complex has an absorption spectrum which is similar to the changed absorption spectrum of the dye when treated with solvent vapors.

13 Claims, 3 Drawing Figures

PHOTOCONDUCTIVE COMPOSITIONS

This application is a continuation-in-part of U.S. patent application Ser. No. 874,971 filed Feb. 3, 1978 now abandoned which is a continuation-in-part of U.S. patent application Ser. No. 855,141 filed Nov. 28, 1977, now abandoned.

FIELD OF THE INVENTION

This invention relates to electrophotography and particularly to light sensitive materials for photoconductive compositions.

BACKGROUND OF THE INVENTION

Electrophotographic imaging processes and techniques have been extensively described in the prior art. Generally, such processes have in common the steps of employing a photoconductive element which is prepared to respond to image-wise exposure to electromagnetic radiation thereby forming a latent-electrostatic-charge image. A variety of subsequent operations, now well-known in the art, can then be employed to produce a permanent record of the image.

One type of photoconductive element particularly useful in electrophotography employs a composition containing a photoconductive material and optionally an electrically insulating, film-forming, resinous binding material. An integrated electrophotographic element incorporating such a composition is generally produced in a multi-layer type of structure by coating a layer of the above described compositions onto a support previously overcoated with a layer of an electrically conducting material. Alternatively, the above-described composition can be coated directly onto a conductive support made of metal or other suitable conductive materials.

Usually, the desired electrophotographic properties are dictated by the end use contemplated for the photoconductive element. In many such applications, it is desirable for the photoconductive element to exhibit high speed, as measured by an electrical speed or characteristic curve, a low residual potential after exposure and resistance to electrical fatigue. Various other applications specifically require that the photoconductive element be capable of accepting a high surface potential with a low dark decay rate.

In many other applications, it is desirable that the photoconductive element be capable of high speeds and relatively high resolution as measured in terms of lines per millimeter. Typical applications where high resolution images are necessary are one to one microfilm reproductions, and the production of microimages from regular sized images. Ideally, a microfilm duplicating system should provide exact micro-duplicates of existing microfilm frames or microimages or normal-sized copy with no loss in resolution from the original.

High speed "heterogeneous" or "aggregate" photoconductive systems have been developed which exhibit many of the desirable qualities mentioned above. These aggregate compositions are the subject matter of Light, U.S. Pat. No. 3,615,414 issued Oct. 25, 1971, Contois et al, U.S. Pat. No. 3,873,311 issued May 25, 1975 and Gramza et al, U.S. Pat. No. 3,732,180 issued May 8, 1973. These heterogeneous or aggregate photoconductive elements comprise photoconductive compositions containing a continuous polymer phase having dispersed therein co-crystalline particles composed of a pyrylium or thiopyrylium salt and a polymer. However, the resolution obtainable with heterogeneous or aggregate photoconductive elements is not as high as the resolution obtainable with some other types of photoconductive elements having much lower speeds such as the elements disclosed in U.S. Pat. No. 3,542,547 and U.S. Pat. No. 3,938,994.

The use of thiopyrylium dye salts in photoconductive compositions is also disclosed in Contois et al, U.S. Pat. No. 3,973,962, issued Aug. 10, 1976 and Van Allan et al, U.S. Pat. No. 3,250,615 issued May 10, 1966. Certain monomethine thiopyrylium dye salts are also disclosed as sensitizers for photoconductive compositions in Reynolds et al, U.S. Pat. No. 3,938,994 issued Feb. 17, 1976.

SUMMARY OF THE INVENTION

The present invention provides, photoconductive compositions and elements which have both high speed and high resolution, wherein the composition comprises a film forming electrically insulating polymer and a dye in the form of a dye-dye complex, having a structure according to the formula

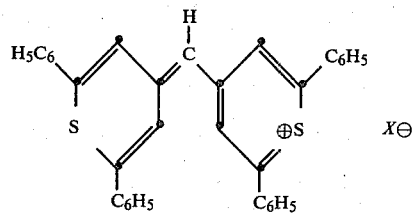

wherein

X⊖ represents an anion; the dye has an absorption spectrum which changes when a binderless coating of the dye is treated with solvent vapors, and the composition containing the dye-dye complex has an absorption spectrum which is similar to the changed absorption spectrum of the dye when treated with solvent vapors.

X⊖ is any monovalent anion such as perchlorate, tetrafluoroborate, etc.

The present invention also provides a method of making the photoconductive compositions of the present invention.

The photoconductive compositions of the present invention are obtained by treating a composition comprising a dye of the type described above and an electrically insulating polymer with solvent vapors of the type described hereinafter. The vapor treatment caused a transformer of the photoconductive composition that is evidenced by a speed increase and a change in the absorption spectrum of said photoconductive composition. As stated above the changed absorption spectrum of the photoconductive composition is substantially similar to the absorption spectrum of the dye used therein when a binderless coating of said dye material is treated with solvent vapors.

The photoconductive compositions of the present invention are different from the aggregate photoconductive compositions disclosed and claimed in the aforementioned Light, Contois et al and Gramza et al patents. The latter aggregate photoconductive compositions result from dye-polymer co-crystallization as evidenced by the co-crystals of dye and polymer which are present in aggregate photoconductive compositions.

The change in absorption spectrum exhibited by vapor treated binderless coatings of the dye of the present invention results from dye-dye interaction rather than dye-polymer co-crystallization. Dye-dye interaction refers to interaction between individual molecules or groups of molecules of the same or similar dye materials. The absorption spectra of the pyrylium dye salts used to form the aforementioned aggregate photoconductive compositions also change when a binderless coating of such dye salts is treated with solvent vapors. However, the absorption spectra of vapor treated compositions comprising an electrically insulating polymer and the aforementioned pyrylium dyes are different from that of a vapor treated binderless coating of the pyrylium dye.

Figure 1:
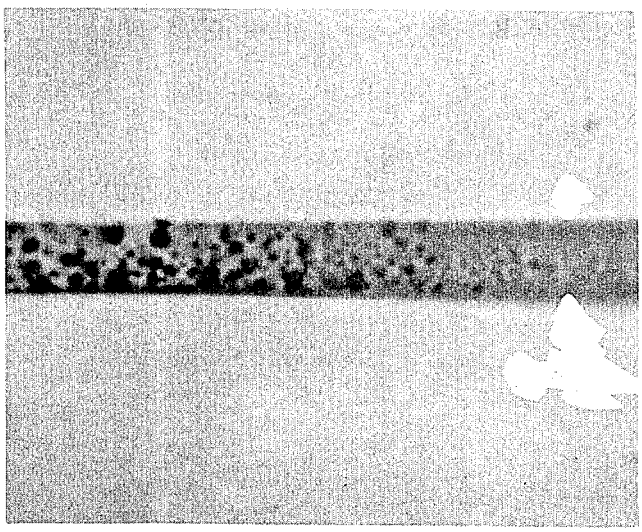
FIG. 1 is a copy of a photomicrograph showing the aggregate particles of conventional prior art aggregate or heterogeneous photoconductive compositions.
Figure 2:
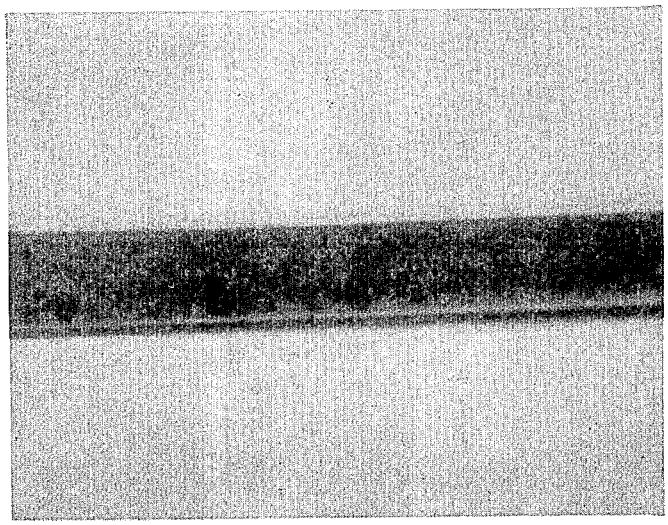
FIG. 2 is a copy of a photomicrograph showing the absence of such aggregate particles in the compositions and elements of the present invention.

Useful materials included within the scope of general Formula I include the materials shown in Table I.

TABLE I

| Dye | Name |
|---|---|
| 1. | 4-[(2,6-diphenyl-4H—thiopyran-4-ylidene)-methyl]-2,6-diphenylthiopyrylium perchlorate |
| 2. | 4-[(2,6-diphenyl-4H—thiopyran-4-ylidene)-methyl]-2,6-diphenylthiopyrylium fluoroborate |

As stated above, the photoconductive compositions of the present invention are obtained by treating compositions comprising a dye as previously described and an electrically insulating polymer with a solvent vapor. The treatment is carried out in several ways. For example, a solution containing the dye, the electrically insulating polymer and, if desired, a material which is an organic photoconductor can be coated in the form of a layer in a conventional manner onto a suitable support. Treatment is then achieved in situ by contact of the coating with the vapors of a solvent until a color change is noted in the coating. Also treatment is achieved by inhibition of solvent removal in an otherwise normal coating operation of a solvent dope containing the dye and polymer and when desired, an organic photoconductor. Similarly, coating such a layer from a solvent mixture which also contains a higher boiling solvent which persists in the coating during drying is among the methods for the desired treatment.

In general, the photoconductive compositions of the examples have been prepared by mixing together separate solutions of the selected dye and the electrically insulating polymer and then, if desired, adding an organic photoconductor. The solution is then coated on a conductive support, such as a nickel-coated poly(ethylene terephthalate) film support, and dried in air or under vacuum at about 60° C. for about one hour. The coated composition is then treated with a solvent vapor for a few minutes and then redried under vacuum for about one hour at about 60° C.

The organic coating solvents useful for preparing coating dopes are selected from a variety of materials. Useful liquids include substituted hydrocarbon solvents, with preferred materials being halogenaated hydrocarbon solvents. The requisite properties of the solvent are that it be capable of dissolving the selected dye material and be capable of dissolving or at least highly swelling or solubilizing the polymeric ingredient of the composition. In addition, it is helpful if the solvent is volatile, preferably having a boiling point of less than about 200° C. Particularly useful solvents include halogenated lower alkanes having from about 1 to about 3 carbon atoms.

The solvents useful in obtaining the photoconductive compositions of the invention include, among others, dichloromethane, toluene, tetrahydrofuran, p-dioxane, chloroform, and 1,1,1-trichloroethane. Such solvents may be used alone or in combination, in which case each component of the combination need not be a solvent for the particular dye material used. The particular solvent(s) used will, in some cases, be determined by the particular combination of electrically insulating polymer, dye and the material used as the organic photoconductor. For example, in some cases one solvent causes a particular polymer, organic photoconductor or dye to precipitate out of the coated composition while other solvents will result in the desired photoconductive compositions.

After treatment according to one of the above procedures, a transformation occurs in the composition being treated. The desired transformation is indicated by increased speed and a change in the absorption spectrum of the solvent treated coated composition. An absorption peak appears in the treated composition in the region of 560 nm, while such peak is not present in the same composition which has not been treated. In this embodiment, the color of the layers shifts from a blue-green to a blue, which is consistent with the change in the absorption spectrum. See FIG. 3.

The amount of dye incorporated into photoconductive compositions and elements of the present invention can be varied over a relatively wide range. When such compositions do not include an organic photoconductive material, the selected dye material may be present in an amount of about 0.1 to about 50.0 percent by weight of the coating composition on a dry basis. Larger or smaller amounts of the dye and dye salts, are also used although best results are generally obtained when using an amount within the aforementioned range. When the compositions include an organic photoconductive material, useful results are obtained by using the dye in amounts of about 0.1 to about 30 percent by weight of the photoconductive coating composition. The upper limit in the amount of dye present in a sensitized layer is determined as a matter of choice and the total amount of any dye material used will vary widely depending on the material selected, the electrophotographic response desired, the proposed structure of the photoconductive element and the mechanical properties desired in the element.

Most electrically insulating film forming polymers are useful in the present invention. Such polymers include polystyrene, polyvinylethers, polyolefins, polythiocarbonates, polycarbonates, and phenolic resins such as those disclosed in U.S. Pat. No. 3,615,414. Mixtures of such polymers are also useful.

Particularly useful polymers have recurring units as shown in Table II.

TABLE II
Polymers
(1)
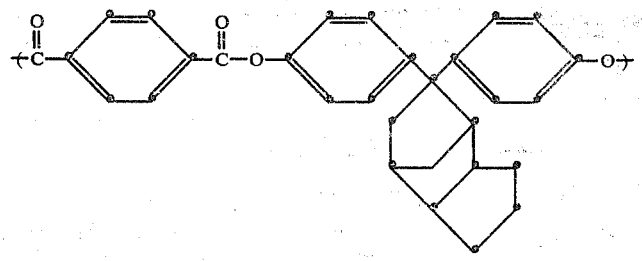
Poly[4,4'-(hexahydro-4,7-methanoindan-5-ylidene)diphenylene terephthalate]
(2)
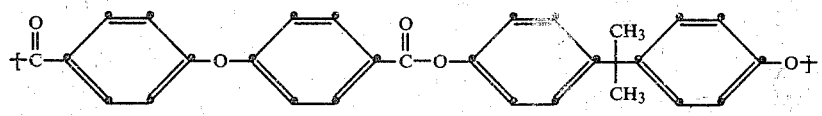
Poly[4,4'-(isopropylidene)diphenylene 4,4'-oxydibenzoate]
(3)
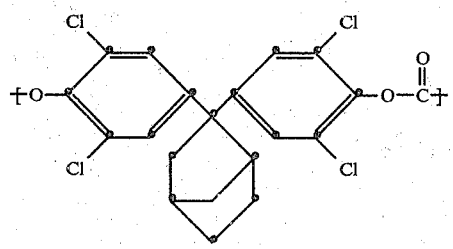
Poly[4,4'-(2-norbornylidene)bis(2,6-dichlorophenylene)carbonate]
(4)
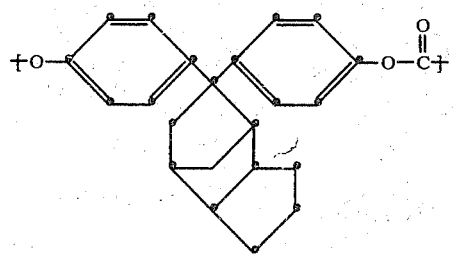
Poly[4,4'-(hexahydro-4,7-methanoindan-5-ylidene)diphenylene carbonate]
(5)
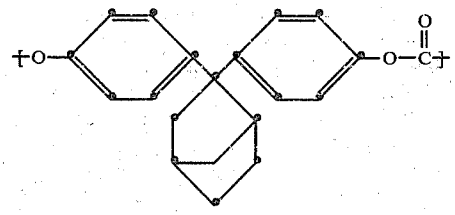
Poly[4,4'-(2-norbornylidene)diphenylene carbonate]
(6)
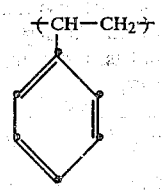
Polystyrene TABLE II-continued

| Polymers |
|---|
| (7) 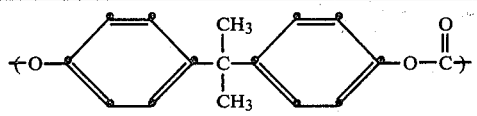 |
| Poly(4,4'-isopropylidenediphenylene carbonate) |

Useful organic photoconductive materials are generally electron acceptor or electron donors for the dye materials. Such materials may be selected from materials designated as organic photoconductors in the patent literature such as those disclosed in U.S. Pat. No. 3,615,414; U.S. Pat. No. 3,873,311; U.S. Pat. No. 3,873,312; U.S. Pat. No. 3,542,547; U.S. Pat. No. 3,542,544 and *Research Disclosure* 10938, Volume 109, May, 1973. These disclosures are expressly incorporated herein by reference. Typical materials include aromatic amines such as tri-p-tolylamine and (di-p-tolylaminophenyl)cyclohexane.

In general, organic photoconductive materials, when used, are present in the composition in an amount equal to at least about 1 weight percent of the coating composition on a dry base. The upper limit in the amount of photoconductor substance present can be widely varied in accordance with usual practice. It is normally required that the organic photoconductor material be present, on a dry basis, in an amount of from about 1 weight percent of the coating composition to the limit of its solubility in the polymeric binder. A polymeric organic photoconductor may also be employed. A preferred weight range for that organic photoconductor in the coating composition is from about 10 weight percent to about 40 weight percent on a dry basis.

Suitable supporting materials for the photoconductive compositions of this invention may include any of a wide variety of electrically conducting supports, for example, paper (at a relative humidity above 20 percent); aluminum-paper laminates; metal foils such as aluminum, copper, zinc, brass and galvanized plates; vapor-deposited metal layers such as silver, chromium, nickel, aluminum, cermet materials and the like coated on paper or conventional photographic film bases such as cellulose acetate, polystyrene. Such conducting materials as nickel can be vacuum deposited on transparent film supports in sufficiently thin layers to allow electrophotographic elements prepared therewith to be exposed from either side of such elements. An especially useful conducting support can be prepared by coating a support material such as poly(ethylene terephthalate) with a conducting layer containing a semiconductor dispersed in a resin. Such conducting layers both with and without insulating barrier layers are described in U.S. Pat. No. 3,245,833 and U.S. Pat. No. 3,880,657. Likewise, a suitable conducting coating can be prepared from the sodium salt of a carboxyester lactone of maleic anhydride and a vinyl acetate polymer. Such kinds of conducting layers and methods for their optimum preparation and use are disclosed in U.S. Pat. Nos. 3,007,901 and 3,262,807.

The photoconductive compositions of this invention can be coated, if desired, directly on a conducting substrate. In some cases, it may be desirable to use one or more intermediate subbing layers between the conducting substrate to improve adhesion to the conducting substrate and/or to act as an electrical barrier layer between the coated composition and the conducting substrate. Such subbing layers, if used, typically have a dry thickness in the range of about 0.1 to about 5 microns. Typical subbing layer materials which may be used are described, for example, in U.S. Pat. No. 3,143,421; U.S. Pat. No. 3,640,708 and U.S. Pat. No. 3,501,301.

Optional overcoat layers may be used in the present invention, if desired. For example, to improve surface hardness and resistance to abrasion, the surface layer of the element of the invention may be overcoated with one or more electrically insulating, organic polymer coatings or electrically insulating, inorganic coatings. A number of such coatings are well known in the art and accordingly extended discussion thereof is unnecessary. Typical useful such overcoats are disclosed, for example, in *Research Disclosure,* "Electrophotographic Elements, Materials and Processes", Volume 109, page 63, Paragraph V, May 1973, which is incorporated herein by reference.

Coating thicknesses of the photoconductive composition on the support can vary widely. Normally, a coating in the range of about 0.5 microns to about 300 microns before drying is useful for the practice of this invention. The preferred range of coating thickness is found to be in the range from about 1.0 microns to about 150 microns before drying, although useful results can be obtained outside of this range. The resultant dry thickness of the coating is preferably between about 2 microns and about 50 microns, although useful results can be obtained with a dry coating thickness between about 1 and about 200 microns.

The photoconductive compositions of the invention are also useful in so-called multi-active photoconductive elements. Such elements have at least two layers comprising an organic photoconductor-containing, charge-transport layer in electrical contact with a charge-generation layer comprising the photoconductive composition of the present invention.

The charge-transport layer contains as the active charge-transport material one or more organic photoconductors capable of accepting and transporting charge carriers generated by the charge-generation layer. The charge-transport layer is free of the composition making up the charge-generation layer. Useful charge-transport materials can generally be divided into two classes depending upon the electronic charge-transport properties of the material. That is, most charge-transport materials generally will preferentially accept and transport either positive charges, i.e. holes, or negative charges, i.e. electrons, generated by the charge-generation layer.

Of course, there are many materials which will accept and transport either positive charges or negative charges; however, even these "amphoteric" materials generally, upon closer investigation, will be found to possess at least a slight preference for the conduction of either positive charge carriers or negative charge carriers. The triarylakane organic photoconductors described in U.S. Pat. No. 3,542,544 are especially useful charge-transport materials in the multi-active elements contemplated by the present invention.

Such multi-active elements are well known in the electrophotographic art and thus need not be discussed in detail here. Berwick et al's U.S. Pat. No. 4,175,960 issued Nov. 27, 1979 describes in detail an especially useful arrangement for multi-active elements. The disclosure thereof, is expressly incorporated herein by reference.

The elements of the present invention can be employed in any of the well-known electrophotographic processes which require photoconductive layers. One such process is the xerographic process. In a process of this type, an electrophotographic element is held in the dark and given a blanket electrostatic charge by treating it with a corona discharge. This uniform charge is retained by the layer because of the substantial dark insulating property of the layer, i.e., the low electrical conductivity of the layer in the dark. The electrostatic charge formed on the surface of the photoconductive layer is then selectively dissipated from the surface of the layer by image-wise exposure to light by means of a conventional exposure operation such as, for example, by a contact-printing technique, or by projection of an image, and the like, to thereby form a latent electrostatic image in the photoconductive layer.

The latent electrostatic image produced by exposure is then developed or transferred to another surface and developed there, i,e., either the charged or uncharged areas are rendered visible, by treatment with a medium comprising electrostatically responsive particles having optical density. The developing electrostatically responsive particles can be in the form of dust, i.e., powder, or a pigment in a resinous carrier, i.e., toner. A preferred method of applying such toner to a latent electrostatic image for solid area development is by the use of a magnetic brush. Methods of forming and using a magnetic brush toner applicator are described in the following U.S. Patents: Young, U.S. Pat. No. 2,786,439 issued Mar. 26, 1957; Giaimo, U.S. Pat. No. 2,786,440 issued Mar. 26, 1957; Young, U.S. Pat. No. 2,786,441 issued Mar. 26, 1957; Grieg, U.S. Pat. No. 2,874,063 isued Feb. 17, 1959. Liquid development of the latent electrostatic image may also be used. In liquid development, the developing particles are carried to the image-bearing surface in an electrically insulating liquid carrier. Methods of development of this type are widely known and have been described in the patent literature, for example, Metcalfe et al, U.S. Pat. No. 2,907,674 issued Oct. 6, 1959. In dry developing processes, the most widely used method of obtaining a permanent record utilizes a developing particle which has as one of its components a thermoplastic resin. Heating the powder image then causes the resin to melt or fuse into or on the element. The powder is, thus caused to adhere permanently to the surface of the photoconductive layer.

The following examples are included for a further understanding of the invention. Each of the exemplified dye materials exhibits (1) a change in absorption spectrum when a binderless coating thereof is treated with a solvent vapor and (2) substantially the same changed absorption spectrum in a solvent vapor treated photoconductive composition which includes said dye material and an electrically insulating polymer.

EXAMPLE 1

Preparation and testing of photoconductive films containing dye material 1, Table I To 12.8 mg of dye 1, Table I, was added 1 ml of dichloromethane, 0.1 ml of HFIP (hexafluoroisopropanol) and 5 ml dichloromethane containing Lexan 145 ® (0.1 g/ml). Lexan 145® is a polycarbonate polymer supplied by General Electric Co., having structure 7 in Table II. The solution was stirred and heated for 5 minutes and then 327 mg of tri-p-tolylamine was added. The final solution was coated on an unsubbed nickel coated poly(ethylene terephthalate) support and air-dried at 55° C. for 5 minutes. The film was then dried in a vacuum oven at 60° C. for one hour. Dry film thickness was 6.0μ.

Figure 3:
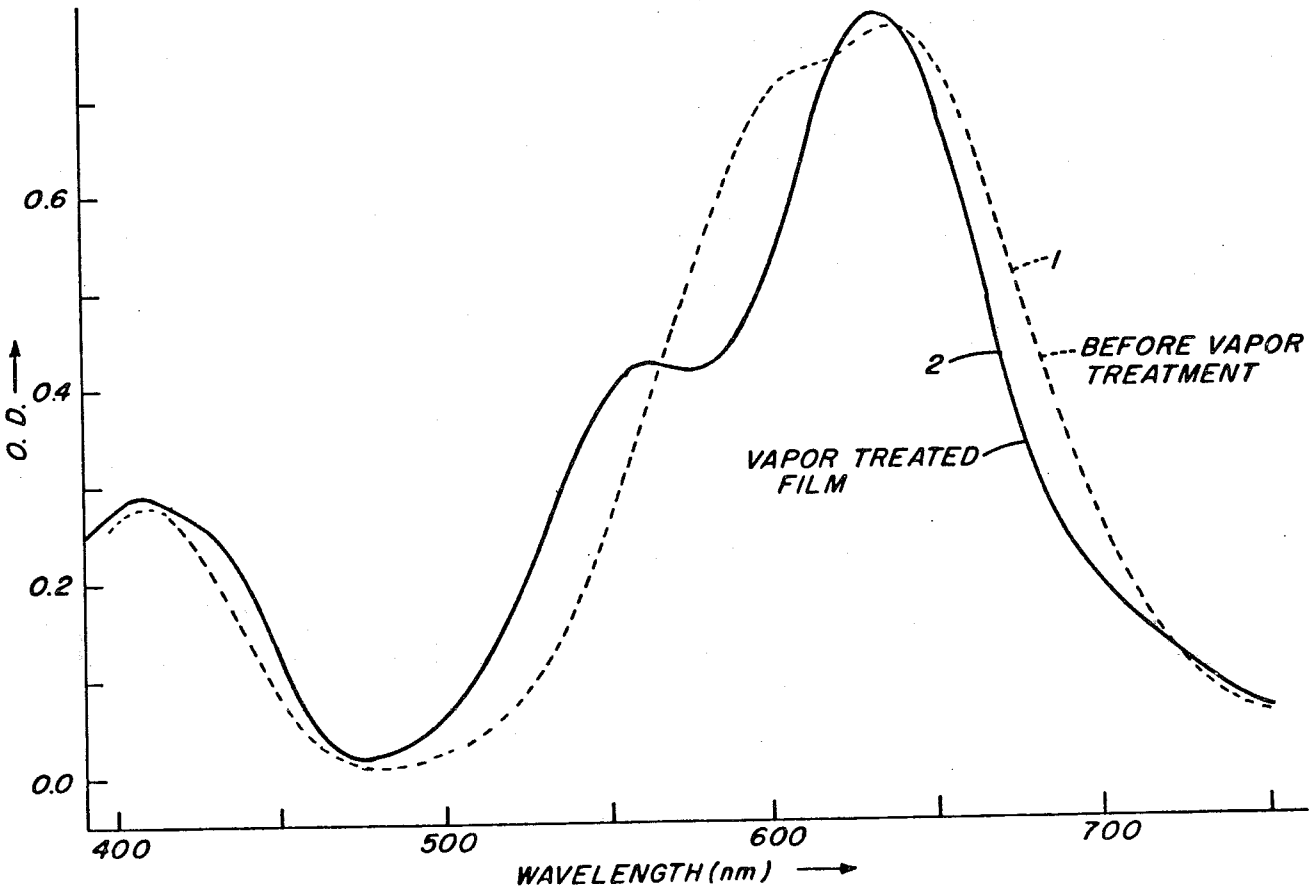
FIG. 3 shows the absorption spectrum of one of the photoconductive compositions of the present invention before and after transformation.

As coated, the film appeared blue-green by transmitted light. A portion of the film was solvent treated for one minute with the vapors of methylene chloride and then dried for one hour at 60° C. in a vacuum oven. Upon solvent treatment the film turned blue. The optical absorption spectrum for this film before and after vapor treatment is shown in FIG. 3. The spectrum was determined in a conventional manner using a Cary 14 spectrophotometer. The spectrum 1 for the untreated film has a peak at about 650 nm and a shoulder at 600 nm. The spectrum 2 for the methylene chloride treated film 2 is shifted with narrow band peaks at 635 nm and 560 nm. The peak at about 560 nm is absent from the untreated film.

The photosensitivity and the electrical speed of each coating was determined as follows:

The front surface of the coating was electrostatically charged negatively under a corona source until the surface potential, as measured by a capacitively coupled probe attached to an electrometer, attained an initial dark value, $V_o$, of −500 volts. The rear surface of the charged coating was then exposed to monochromatic visible radiation at 640 nm, a wavelength near the optical absorption maxima of the dye. The exposure caused reduction of the surface potential of the element from −500 volts to −100 volts. The photosensitivity of the element is considered equivalent to the exposure in ergs/cm$^2$ necessary to discharge the element from −500 to −100 volts, after correction for light absorption and reflection by the film support. The less exposure required, the more photosensitive the material.

The photosensitivities (at 640 nm) of the untreated control film and the solvent treated film of the above composition are listed in the following table.

| Exposure Configuration | Photosensitivity of Solvent Treated Film (ergs/cm$^2$) | Photosensitivity of Control (ergs/cm$^2$) |
|---|---|---|
| Negative Charge Rear Exposure | 8 | 189 |

EXAMPLE 2

A photoconductive film containing dye 2, Table I was tested as in Example 1. Upon vapor treatment the films changed from blue-green to blue and exhibited the same absorption and speed characteristics as dye 1.

EXAMPLE 3

This example was prepared to show the combination of high speed and good resolution possessed by photoconductive films comprising the dye of the present invention compared to the speed and resolution of typical homogenous photoconductive films containing a photoconductor described in U.S. Pat. No. 3,542,547 and a sensitizer described in U.S. Pat. No. 2,938,994 (Film A) and conventional aggregate photoconductive films such as those described in U.S. Pat. No. 3,615,414 and U.S. Pat. No. 3,873,311.

Four photoconductive films were prepared. Film A was a homogenous film. Film B was an aggregate film. Films C and D include the dye of the invention. Each film included the following listed materials.

| | |
|---|---|
| **Film A** | |
| (a) $CH_2Cl_2$ | 17.6 g |
| (b) 2,4-bis(4-ethoxyphenyl)-6-(4-pentyloxystyryl)pyrylium tetrafluoroborate | 0.04 g |
| (c) 4[2,6-bis(4-amyloxyphenyl)-4H—pyran-4-ylidene)methyl]-2,6-bis(4-amyloxyphenyl)-pyrylium perchlorate described in U.S. Pat. No. 3,938,994 having the structure | 0.01 g |

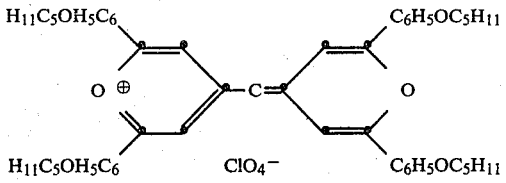

| | |
|---|---|
| (d) Vitel PE 101 polyester (Goodyear) | 1.8 g |
| (e) 4,4'-bis(diethylamino-2,2'-dimethyltriphenyl)methane | 0.6 g |
| **Film B** | |
| (a) $CH_2Cl_2$ | 10.2 g |
| (b) 1,1,2-trichloroethane | 6.8 g |
| (c) Lexan 145 polycarbonate | 1.9 g |
| (d) 4-(p-dimethylaminophenyl)-2,6-diphenylthiopyrylium tetrafluoroborate described in U.S. Pat. No. 3,615,414 having the structure | 0.09 g |

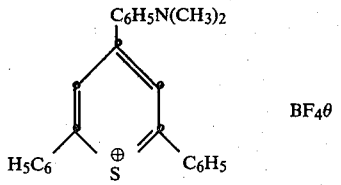

| | |
|---|---|
| (e) 4,4'-bis(diethylamino)-2,2'-dimethyltriphenylmethane | 1.2 g |
| **Film C** | |
| (a) $CH_2Cl_2$ | 34.32 g |
| (b) Hexafluoroisopropanol | 0.84 g |
| (c) 4-[2,6-diphenyl-4H—thiopyran-4-ylidene)methyl]-2,6-diphenylthiopyrylium perchlorate (Dye 1) | 0.126 g |
| (d) Lexan 145 polycarbonate | 3.0 g |
| (e) Tri-p-tolylamine | 1.88 g |
| (f) Poly[(oxycarbonylethylene-1,4-phenylene-2-cyanovinylene-1,4-phenylene-1-cyanovinylene-1,4-phenylene(phenylamino)-1,4-phenylene ethylenecarbonyloxydecamethylene] | 0.15 g |
| (g) Toluene | 5.64 g |
| **Film D** | |
| (a) $CH_2Cl_2$ | 34.32 g |
| (b) Hexafluoroisopropanol | 0.84 g |
| (c) 4-[2,6-Diphenyl-4H—thiopyran-4-ylidene)methyl]-2,6-diphenylthiopyrylium perchlorate (Dye 1) | 0.126 g |
| (d) Lexan 145 polycarbonate | 3.0 g |
| (e) 4,4'-diethylamino-2,2'-dimethyltriphenylmethane | 1.88 g |
| (f) Toluene | 5.64 g |

Each coating composition was made 24 hours prior to coating by dissolving the components in the order listed, allowing sufficient time between additions for complete solvation. Each composition was coated on a transparent nickel or cuprous iodide conductive support. Coating A was made at a coverage of 7.5 gms/m$^2$. Coating B was made at a coverage of 11.3 gms/m$^2$. Coatings C and D were made at a coverage of 7.5 gms/m$^2$. The coatings were then dried.

Photosensitivity and resolution data are presented in Table III. Photosensitivity was determined as in Example 1 before and after solvent treatment for negative charging at a wavelength where the optical density of the film equals 1.0. Discharge was from −600 V to −100 V.

The method of measuring resolution consisted of exposing each film to a standardized contact print test object having a resolving power up to nearly 800 lines/mm, consisting of dark lines on a transparent background. The lines were of fairly high density having a contrast ratio of at least 1000:1.

The films were charged negatively to 600 volts and then exposed to the resolution test object so that areas of maximum exposure were discharged to 350–400 volts, resulting in a ΔV of 200 to 250 volts. The test object, a silver halide film, was drawn into intimate contact with the charged film using vacuum.

Exposure was made with a tungsten lamp, having a small filament, spaced approximately one meter away from the test sample. This spacing was such that it approximated a point source of illumination and resulted in essentially parallel rays of light for obtaining optimum resolution.

After exposure, the latent image was developed with a liquid toner, having small marking particles of only several tenths of microns diameter, resulting in a positive-appearing image of the original. Resolution of each film was determined by observation of the maximum number of lines/mm reproduced from the original.

The data in this table shows that photoconductive film elements C and D comprising the composition of the present invention have better resolution and better speed than the photoconductive elements A and B which are representative of the prior art. Thus, the unique dye of the present invention provides photoconductive films which possess both high speed and high resolution. This result is surprising since the structurally similar dyes in Films A and B fail to produce films having both high speed and high resolution.

TABLE III

| Photoconductive Film | Wavelength nm | Speed[2] cm$^2$/erg | Photosensitivity[1] erg/cm$^2$ | Resolution (lines/mm) Contact[3] |
|---|---|---|---|---|
| A | 450 | $2.8 \times 10^{-3}$ | 358.0 | 282 |
| B | 580 | $9.6 \times 10^{-2}$ | 10.4 | 112 |
| C | 600 | $6.9 \times 10^{-2}$ | 14.5 | 355 |
| D | 600 | $5.4 \times 10^{-2}$ | 18.5 | 355 |

[1]Sensitivity for discharge from −600 V to −100 V.
[2]Front surface exposure speed equals 1/sensitivity.
[3]Resolution determined by contacting film with original during exposure.

To demonstrate the unexpected nature of the dye of the present invention, further comparative data is presented which illustrates that many dyes having closely related structures do not provide high resolution, high speed photoconductive compositions.

EXAMPLE 4–8

Five different films were prepared, vapor treated and tested as in Example 1 except that the dye of the invention was replaced in each film by a different dye having a structure similar to the dye of the invention. The five films and the associated dyes were as follows:

Film E — 4-[(2,6-diphenyl-4H—thiopyran-4-ylidene)methyl]-2,6-diphenylseleno-pyrylium perchlorate

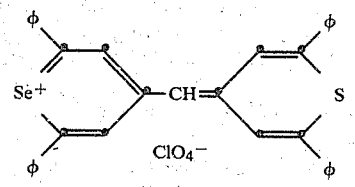

Film F — 4-[(2,6-diphenyl-4H—pyran-4-ylidene)-methyl]-2,6-diphenylthiopyrylium perchlorate

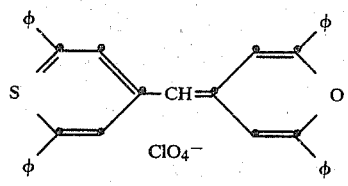

Film G — 4-[(2,6-diphenyl-4H—pyran-4-ylidene)-methyl]-2,6-diphenylselenopyrylium perchlorate

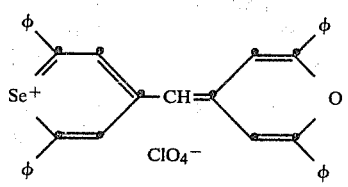

Film H — 4-[2,6-diphenyl-4H—pyran-4-ylidene)-methyl]-2,6-diphenylpyrylium perchlorate

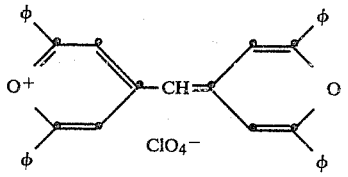

Film I — 4-[2,6-di{4-fluorophenyl}-4H—thiopyran-4-ylidene)methyl]-2,6-di(4-fluorophenyl)-thiopyrylium perchlorate

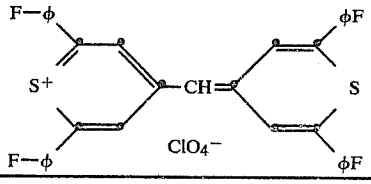

The speed of each of the films increased upon vapor treatment. However, the films contain particles greater than 0.25μ. Hence, the resolving power of these compositions would be similar or less than that of Film B in Example 2. The dyes of Films F and H are also described in aforementioned U.S. Pat. No. 3,938,994.

EXAMPLES 9–14

Six different polymers having the recurring units 1, 2, 3, 4, 5 and 6 from Table II were used to make six photoconductive films, each containing a different polymer. Each film contained dye 1, Table I. The films were prepared substantially in accordance with Example 2. Each film was found to have greater photosensitivity after vapor treatment than before such treatment. Each vapor treated film also had a spectral peak at about 560 nm which did not appear in the film before vapor treatment. These Examples 13–18 also show tht the change in absorption spectrum and enhanced speed is independent of the polymer material. Hence, the transformation apparently results from dye-dye interaction instead of dye-polymer co-crystallization.

The invention has been described in detail with particular reference to preferred embodiments thereof, but it will be understood that variations and modifications can be effected within the spirit and scope of the invention.

We claim:

1. A photoconductive composition having both high speed and high resolution, wherein the composition comprises a film forming electrically insulating polymer and a dye in the form of a dye-dye complex, having a structure according to the formula

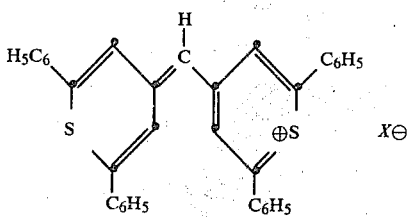

wherein X⊖ represents an anion; the dye has an absorption spectrum which changes when a binderless coating of the dye is treated with solvent vapors, and the composition containing the dye-dye complex has an absorption spectrum which is similar to the changed absorption spectrum of the dye when treated with solvent vapors.

2. The composition of claim 1 wherein X is perchlorate.

3. The composition of claim 1 or 2 wherein the composition also includes an organic photoconductor.

4. The composition of claim 1 or 2 wherein the composition includes an organic photoconductor selected from the group consisting of tri-p-tolylamine and (di-p-tolylaminophenyl)cyclohexane.

5. The composition of claim 1 or 2 wherein the dye is present in said composition in an amount of about 0.001 to 30 weight percent on a dry basis.

6. The composition of claim 1 or 2 wherein the polymer is selected from the group consisting of poly[4,4'-(hexahydro-4,7-methanoindan-5-ylidene)diphenylene terephthalate]; poly[4,4'-(isopropylidene)diphenylene-4,4'-oxydibenzoate]; poly[4,4'-(2-noprbornylidene)bis-(2,6-dichlorophenylene)carbonate]; poly[4,4'-(hexahydro-4,7'-methanoindan-5-ylidene)diphenylene carbonate]; poly[4,4'-(2-norbornylidene)diphenylene carbonate]; polystyrene and poly(4,4'-isopropylidenediphenylene carbonate).

7. An electrophotographic element comprising a conductive support, a layer of a photoconductive composition having high speed and high resolution, wherein the composition comprises a film forming electrically insulating polymer and a dye in the form of a dye-dye complex, having a structure according to the formula

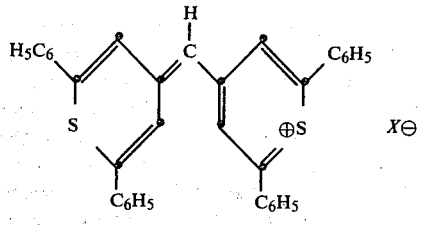

wherein X⊖ represents an anion; the dye has an absorption spectrum which changes when a binderless coating of the dye is treated with solvent vapors, and the composition containing the dye-dye complex has an absorption spectrum which is similar to the changed absorption spectrum of the dye when treated with solvent vapors.

8. The element of claim 1 wherein x is perchlorate.

9. The element of claim 1 or 2 wherein the composition includes an organic photoconductor.

10. The element of claim 1 or 2 wherein the composition includes an organic photoconductor selected from the group consisting of tri-p-tolylamine and (di-p-tolylaminophenyl)cyclohexane.

11. The element of claim 1 or 2 wherein the dye is present in said composition in an amount of about 0.001 to 30 weight percent on a dry basis.

12. The element of claim 1 or 2 wherein the polymer is selected from the group consisting of poly[4,4'-(hexahydro-4,7-methanoindan-5-ylidene)diphenylene terephthalate]; poly[4,4'-(isopropylidene)-diphenylene-4,4'-oxydibenzoate]; poly[4,4'-(2-norbornylidene)bis-(2,6-dichlorophenylene)carbonate]; poly[4,4'-(hexahydro-4,7'-methanoindan-5-ylidene)-diphenylene carbonate]; poly[4,4'-(2-norbornylidene)diphenylene carbonate]; polystyrene and poly(4,4'-isopropylidenediphenylene carbonate).

13. The element of claim 1 or 2 which also includes a charge-transport layer, thereby forming a multi-active photoconductive element.

* * * * *

UNITED STATES PATENT AND TRADEMARK OFFICE

CERTIFICATE OF CORRECTION

PATENT NO. 4,429,030

DATED January 31, 1984

INVENTOR(S) J. H. Perlstein, G. A. Reynolds, J. A. VanAllan & S. P. Clark

It is certified that error appears in the above-identified patent and that said Letters Patent are hereby corrected as shown below:

Col. 14, line 66 reading "(2-noprbornylidene)" should read --(2-norbornylidene)--.

Signed and Sealed this

*Fifth* Day of *June 1984*

[SEAL]

*Attest:*

GERALD J. MOSSINGHOFF

*Attesting Officer*

*Commissioner of Patents and Trademarks*